US008567900B2

(12) United States Patent
Saeki

(10) Patent No.: US 8,567,900 B2
(45) Date of Patent: Oct. 29, 2013

(54) INK JET RECORDING APPARATUS

(75) Inventor: Tsuyoshi Saeki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 13/219,365

(22) Filed: Aug. 26, 2011

(65) Prior Publication Data

US 2012/0050401 A1 Mar. 1, 2012

(30) Foreign Application Priority Data

Aug. 31, 2010 (JP) ..... 2010-193576

(51) Int. Cl.
*B41J 2/165* (2006.01)

(52) U.S. Cl.
USPC ..... 347/29; 347/30; 347/31; 347/32

(58) Field of Classification Search
USPC ..... 347/29–32
See application file for complete search history.

(56) References Cited

U.S. PATENT DOCUMENTS

| | | | | |
|---|---|---|---|---|
| 7,695,097 | B2 * | 4/2010 | Morgan et al. | 347/33 |
| 2002/0033859 | A1 * | 3/2002 | Mitsuzawa et al. | 347/23 |

FOREIGN PATENT DOCUMENTS

| | | | |
|---|---|---|---|
| JP | 2001-105615 | A | 4/2001 |
| JP | 2007-130862 | A | 5/2007 |
| JP | 2010-69759 | A | 4/2010 |

* cited by examiner

*Primary Examiner* — Henok Legesse
(74) *Attorney, Agent, or Firm* — Canon USA, Inc., I.P. Division

(57) ABSTRACT

The present invention suppresses deformation of a cap that protects a recording head when a negative pressure is generated, thereby enabling an appropriate capping operation. An ink jet recording apparatus includes a cap having a bottom, the bottom facing an ejection port surface of a recording head, and a side wall surrounding the bottom, the ejection port surface having ejection ports; and a retaining member configured to retain the cap on the inkjet recording apparatus. A restricting member that covers the bottom is provided inside the side wall of the cap, and the restricting member is fixed to the retaining member.

7 Claims, 7 Drawing Sheets

INK JET RECORDING APPARATUS

BACKGROUND OF THE INVENTION

1. Field of the Invention

The present invention relates to ink jet recording apparatuses. More specifically, the present invention relates to a cap unit including a cap for covering one surface of a recording head in which ejection ports are provided (hereinafter referred to as an "ejection port surface").

2. Description of the Related Art

A cap unit of an ink jet recording apparatus prevents and eliminates clogging in ejection ports by covering an ejection port surface to form an enclosed space and causing a suction pump to generate a negative pressure in the enclosed space to forcibly discharge ink from the ejection ports. The pressure in the cap at this time can reach 0.2 atm. FIG. 9 shows the structure of a conventional cap unit. A cap 101 in FIG. 9 is made of a soft material, such as rubber, and is brought into intimate contact with an ejection port surface to form an enclosed space. The cap 101 has holes corresponding to tubular ink discharge ports 103 and air communication ports 104 provided in a cap holder 102. When the inner circumferential surfaces of the holes in the cap are brought into intimate contact with the outer circumferential surfaces of the ink discharge ports 103 and air communication ports 104, an enclosed space is formed by the ejection port surface and the cap. Therefore, when the suction pump produces a negative pressure in the enclosed space, the cap 101 is deformed. More specifically, the outer circumferential side wall of the cap 101 leans inward, and the bottom of the cap 101 tends to be deformed toward the ejection port surface. At this time, in an apparatus in which particularly great negative pressure is produced in the cap 101, the deformation tends to be excessive. As a result, improper sealing may occur, failing to form an enclosed space and causing suction failure. Furthermore, if the deformation of the bottom of the cap 101 due to friction or the like between the cap 101 and the cap holder 102 remains after the cap is opened, it is difficult to form an enclosed space in the next capping operation.

Japanese Patent Laid-Open No. 2001-105615 discloses a cap in which a portion that is brought into contact with an ejection port surface is formed such that it covers reinforcing ribs formed on a cap holder. In this cap, the portion formed such that it covers the reinforcing ribs formed on the cap holder is engaged with an engaging portion formed on the cap holder, thereby preventing deformation of the cap.

Japanese Patent Laid-Open No. 2001-105615 also discloses that the cap and the cap holder are integrally molded by coinjection molding. Because the contact surfaces of the cap and cap holder are bonded, deformation of the cap can be prevented.

In the cap disclosed in Japanese Patent Laid-Open No. 2001-105615, deformation of the portion that is brought into intimate contact with the ejection port surface, i.e., a portion near the side wall of the cap, can be suppressed. However, deformation of the bottom of the cap resulting from long-term use cannot be suppressed. Thus, it may be difficult to form a sufficient sealing surface with respect to the ink discharge ports and the air communication ports.

The cap is deformed by a negative pressure every time the suction operation is performed. Thus, the contact surfaces of the cap and cap holder, which are integrally molded by coinjection molding, can be separated. Furthermore, because the materials of the cap used in the coinjection molding are limited, selection of the materials taking functions, such as gas permeability, resistance to ink, and attachment to the ejection port surface, into consideration is difficult. In addition, because the cap and the cap holder are integrally molded, disassembling maintenance is difficult.

SUMMARY OF THE INVENTION

With the present invention, deformation of a cap when a negative pressure is produced can be sufficiently suppressed, whereby a recording head can be maintained in good condition.

The present invention provides an ink jet recording apparatus including a cap having a bottom, the bottom facing an ejection port surface of a recording head, and a side wall surrounding the bottom, the ejection port surface having ejection ports; a retaining member configured to retain the cap on the inkjet recording apparatus; and a restricting member provided inside the side wall, the restricting member being configured to cover the bottom. The restricting member is fixed to the retaining member.

Further features of the present invention will become apparent from the following description of exemplary embodiments with reference to the attached drawings.

DESCRIPTION OF THE EMBODIMENTS

First Embodiment

An ink jet recording apparatus according to a first embodiment of the present invention will be described below. The mechanical sections that constitute the ink jet recording apparatus (hereinafter simply referred to as a "recording apparatus") according to this embodiment can be classified into a sheet-feed section, a sheet-conveying section, a sheet-output section, a carriage section, a recovery mechanism section, etc., according to their functions. Each mechanical section will be described below.

Sheet-Feed Section

Figure 1:
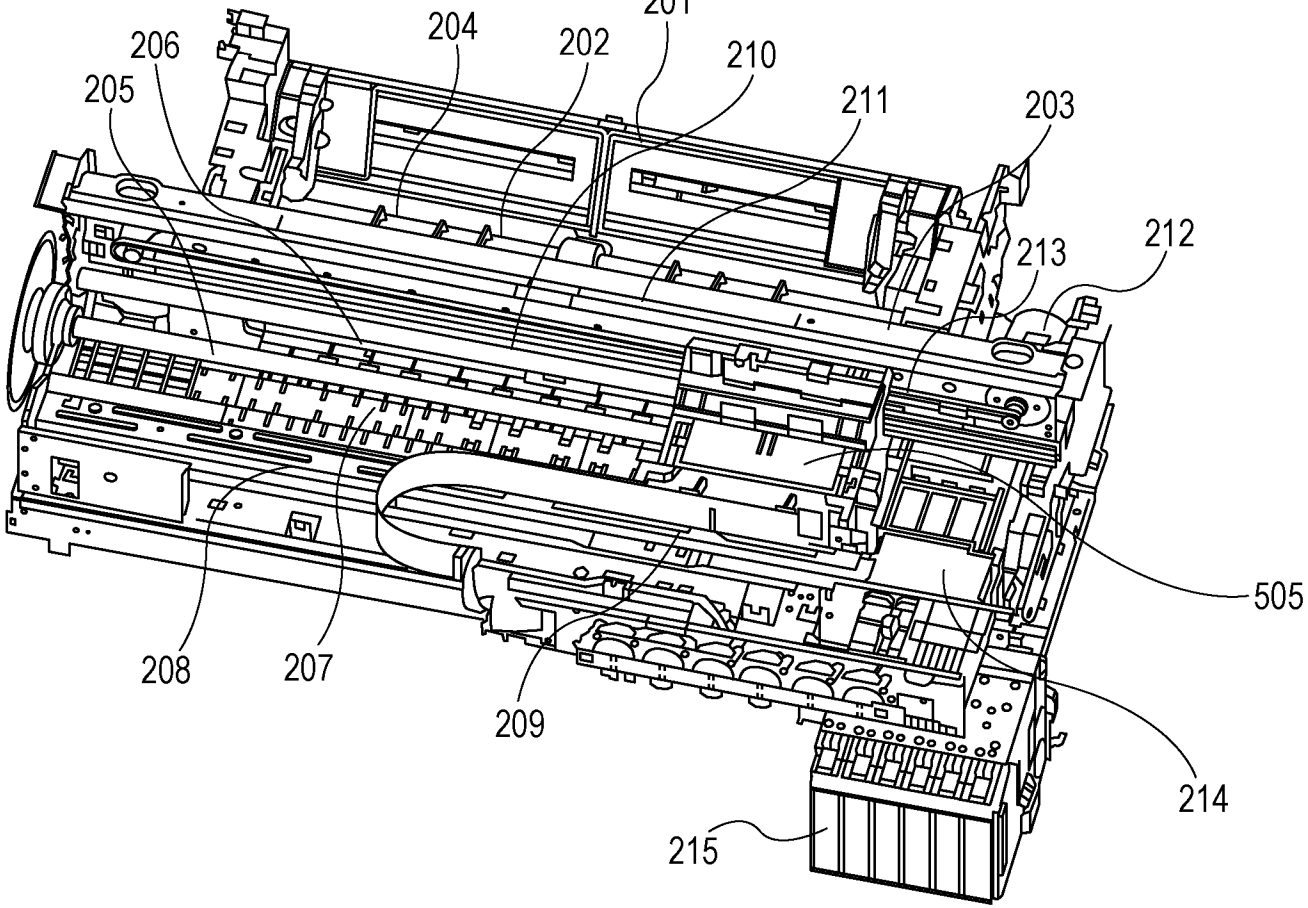
FIG. 1 is a perspective view showing an example of an ink jet recording apparatus according to an embodiment of the present invention.

As shown in FIG. 1, a sheet-feed section includes a pressure plate 201 on which recording media are placed, a sheet-feed roller 202 that feeds the recording media one-by-one, a separation roller (not shown) that separates the recording media, and a base 203 on which the aforementioned components are placed.

Sheet-Conveying Section

A sheet-conveying section includes a chassis 204 and a conveying roller 205 attached to the chassis 204. A plurality of pinch rollers 206 driven by the conveying roller 205 are provided so as to be in contact with the conveying roller 205. The pinch rollers 206 are in contact with the conveying roller 205 at a predetermined pressure, thereby producing a conveying force for conveying the recording media.

A recording medium sent to the sheet-conveying section is sent to a roller pair consisting of the conveying roller 205 and the pinch rollers 206 and is conveyed onto a platen 207. The platen 207 has ribs, which serve as a conveyance reference surface. The ribs not only regulate the gap between an ejection port surface of a recording head 505 and the surface of a recording medium, but also prevent the recording medium from becoming wavy.

Sheet-Output Section

The sheet-output section includes a sheet-output roller 208 and a plurality of spurs (not shown) driven by the sheet-output roller 208. The spurs are in contact with the sheet-output roller 208 at a predetermined pressure, and the recording medium on which an image is formed is nipped and conveyed by the sheet-output roller 208 and the spurs.

Carriage Section

The carriage section includes a carriage 209 carrying the recording head 505. The carriage 209 is guided by a guide shaft 210 and a guide rail 211. The guide shaft 210 supports and guides the carriage 209 such that it can reciprocate in a direction intersecting a conveying direction of the recording medium (main scanning direction). The guide rail 211 holds the trailing end of the carriage 209 and maintains the gap between the ejection port surface of the recording head 505 and the recording medium. The carriage 209 is driven via a timing belt 213 by a carriage motor 212 attached to the chassis 204.

In the above-described structure, when an image is formed on a recording medium, the recording medium is conveyed in a sub-scanning direction (conveying direction) by the roller pair consisting of the conveying roller 205 and the pinch rollers 206. The recording head 505 ejects ink onto the recording medium conveyed in the sub-scanning direction, based on signals transmitted from an electric substrate. The recording apparatus according to this embodiment forms an image on the recording medium by repeatedly and alternately performing conveyance of the recording head 505 in the main scanning direction and the conveyance of the recording medium in the sub-scanning direction.

Recovery Mechanism Section

Figure 2:
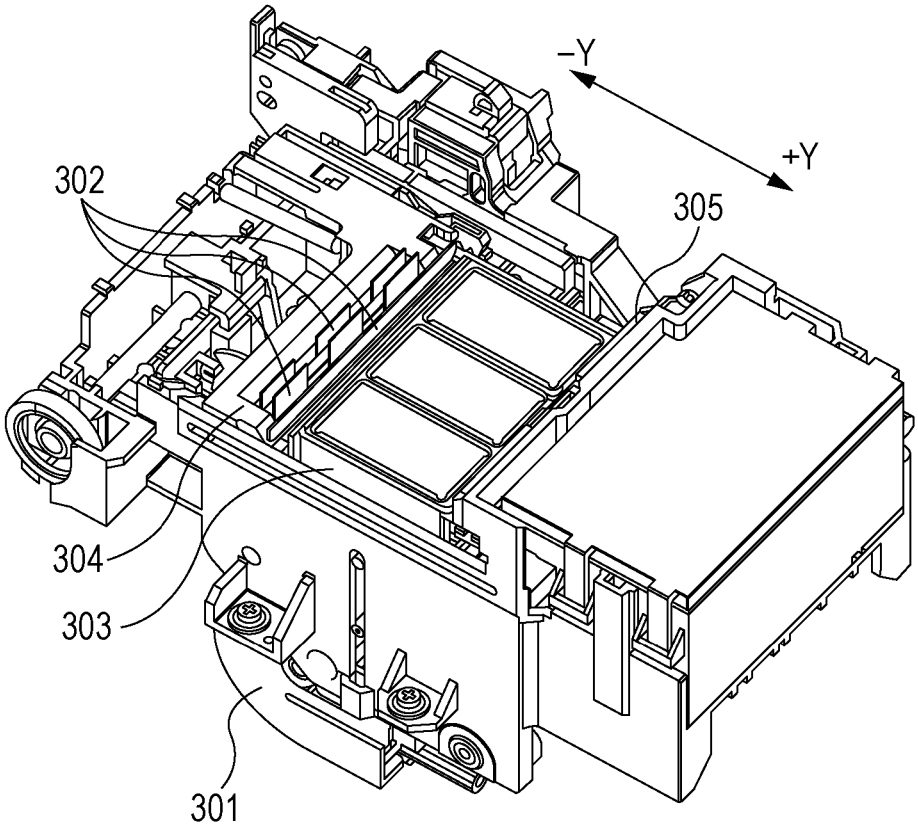
FIG. 2 is a perspective view of a recovery mechanism section of the recording apparatus in FIG. 1.

A recovery mechanism section 214 is for maintenance and recovery of the ink eject performance of the recording head 505. FIG. 2 shows the detail of the recovery mechanism section 214.

The recovery mechanism section 214 includes a suction pump 301 for sucking ink from the ejection ports in the recording head 505 (FIG. 1) and wipers 302 for wiping the ejection ports in the recording head 505. The recovery mechanism section 214 also includes a cap 303 for preventing the ejection ports in the recording head 505 from drying. The cap 303 is driven by a driving force from a sheet-feed motor (not shown) for driving the sheet-feed section. A one-way clutch (not shown) is provided so that the rotation of the sheet-feed motor in one direction activates the suction pump 301 and so that the rotation thereof in the opposite direction causes the wipers 302 to perform wiping and causes the cap 303 to perform intimate contact and separation operations.

The wipers 302 are made of an elastic member, such as rubber. The wipers 302 are fixed to a wiper holder 304. The wiper holder 304 can be moved in +Y and −Y directions (the direction in which the ejection ports are arrayed in the ejection port surface) in FIG. 2. By moving the wiper holder 304 in the +Y direction indicated by the arrow when the recording head 505 is positioned in a moving range of the wipers 302, wiping is performed. Once the wiping is completed, the carriage 209 (FIG. 1) is retracted from the wiping area, and the wipers 302 are returned to a position where they do not interfere with the ejection port surface or the like. At this time, the wipers 302 are brought into contact with the wiper cleaner 305 to remove the ink deposited on the wipers 302.

The suction pump 301 can generate a negative pressure in the cap 303 when the cap 303 is brought into intimate contact with the ejection port surface, forming an enclosed space therein. This enables an ink tank 215 shown in FIG. 1 to supply ink to an ejecting portion of the recording head 505 and enables dust, deposited matter, bubbles, etc., in the ejection ports or ink flow paths located inside the ejection ports to be sucked and removed.

The suction pump 301 is of a tube-pump type, for example. The pump of this type is composed of, for example, a flexible tube, a member having a curved surface that supports at least a portion of the tube extending along the curved surface, a roller that can press the tube against the member, and a roller support portion that can support and rotate the roller. By rotating the roller support portion in a predetermined direction, the roller rotates over the member having the curved surface while pressing the flexible tube. This causes the enclosed space formed by the cap 303 to generate a negative pressure, causing ink to be sucked from the ejection ports and drawing ink from the cap 303 into the tube or the suction pump 301. The ink drawn therein is guided to an ink absorbing member (not shown) provided on a downstream side.

Figure 3:
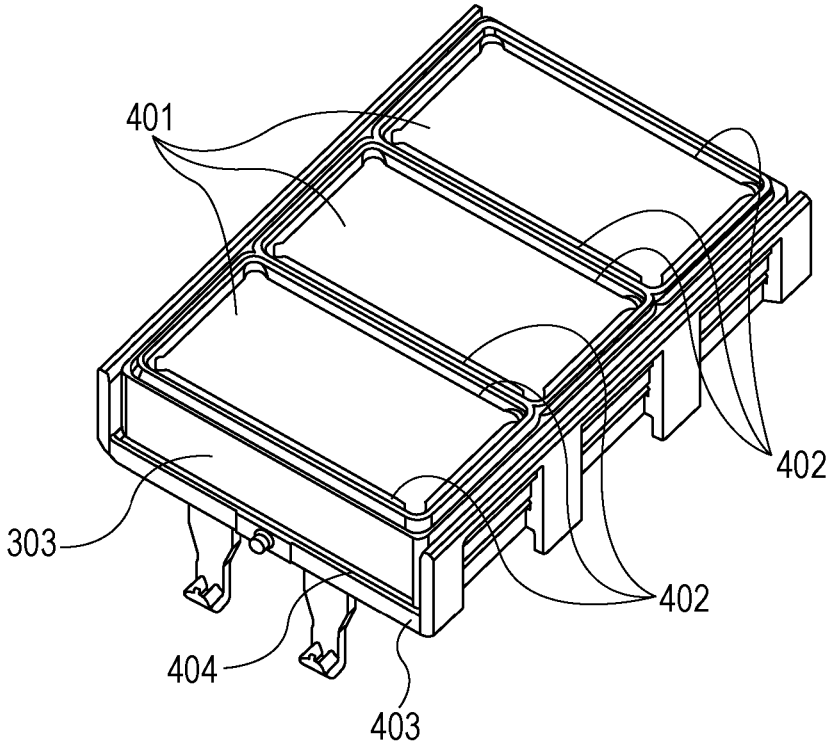
FIG. 3 is an enlarged view of a cap unit of the recovery mechanism section in FIG. 2.

FIG. 3 is an enlarged view of the cap unit. The cap 303 includes a bottom 303*a* facing the ejection port surface of the recording head 505 and a side wall 303*b* surrounding the bottom 303*a*. Ink absorbing members 401 are provided inside the cap 303 surrounded by the side wall 303*b* to reduce the amount of ink remaining on the ejection port surface after the suction. Ink-absorbing-member holding portions 402 are provided inside the cap 303, at an upper portion, to prevent the ink absorbing members 401 from coming off.

Furthermore, deposition of ink and color mixing are prevented by sucking the ink remaining in the cap 303 or the ink absorbing members 401 while the cap 303 is opened to the air. In a more suitable configuration, an air communication valve (not shown), which is opened in advance when the cap 303 is separated from the ejection port surface, is provided somewhere in the middle of an ink-suction path, thereby preventing a negative pressure from suddenly acting on the ejection port surface.

The suction pump 301 can be operated not only for the suction operation, but also for discharging ink collected in the cap 303 as a result of a so-called pre-ejection operation, in which ink not contributing to image recording is ejected from the recording head 505 to the cap 303. That is, by operating the suction pump 301 when the pre-ejected ink in the cap 303 has reached a predetermined amount, the ink collected in the cap 303 can be transferred to the ink absorbing member (not shown) on a downstream side. The pre-ejection operation is performed when the cap 303 faces the ejection port surface.

The cap 303 is lifted/lowered by the sheet-feed motor and performs capping of a plurality of chips provided on the recording head 505 at a lifted position. The cap 303 according to this embodiment has integrally formed three chambers. The capping enables the ejection port surface to be protected or the suction operation to be performed while recording operation is not performed. During the suction operation, the ink is sucked and discharged from the recording head 505 into the cap 303 together with thickened matter and bubbles. During the recording operation, the cap 303 is moved to a lowered position so as not to interfere with the recording head 505. At a lowered position, the cap 303 faces the ejection port surface and can receive ink ejected from the recording head 505 in the pre-ejection.

In this embodiment, in addition to a cap holder 403 serving as the cap retaining member, a flat metal plate 404 that is brought into intimate contact with the outer surface of the bottom of the cap 303 is provided. The metal plate 404 improves the flatness of the cap 303 so that the cap 303 can be appropriately brought into intimate contact with the ejection port surface.

A series of continuous operations, including the operation of the wipers 302 and the lifting/lowering of the cap 303, can be controlled by a main cam (not shown) provided on an output shaft of the sheet-feed motor and a plurality of cams, arms, and the like driven by the main cam. That is, pivoting of the main cam in the rotation direction of the sheet-feed motor causes the cams and the arms to move, performing a predetermined operation. The position of the main cam can be detected by a position detection sensor, such as a photo-interrupter.

Ink-Flow-Path Section

Figure 4:
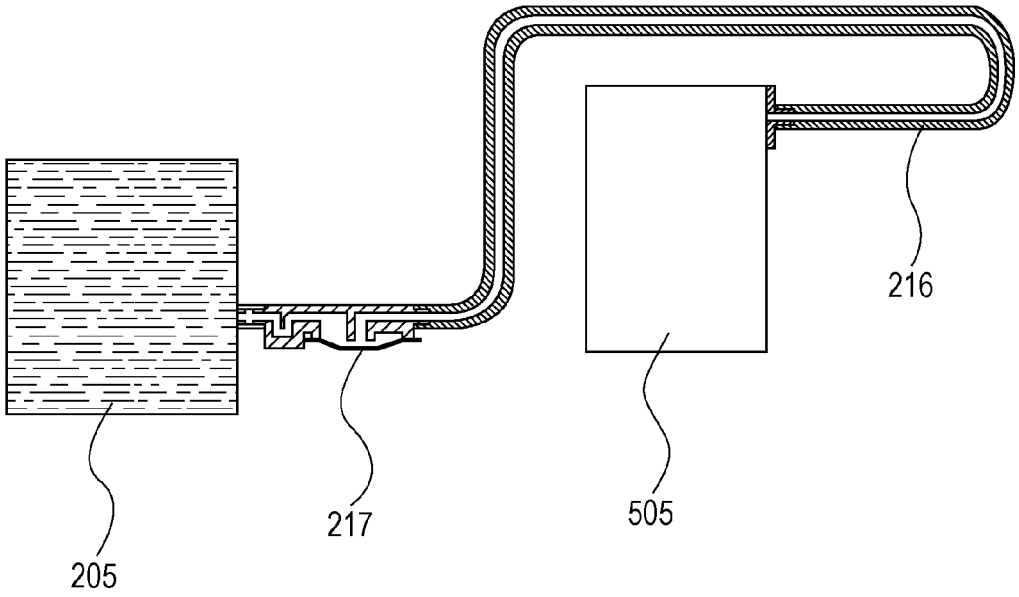
FIG. 4 is a schematic view of an ink-flow-path section of the recording apparatus in FIG. 1.

FIG. 4 is a schematic view of an ink-flow-path section. A differential pressure regulating valve 217 is provided somewhere in the middle of the ink flow path 216 connecting between the ink tank 205 and the recording head 505. The differential pressure regulating valve 217 is made of a flexible member. The differential pressure regulating valve 217 is closed when a negative pressure exceeding a predetermined level is generated in the flow path on the recording head 505 side with respect to the differential pressure regulating valve 217 (hereinafter referred to as a "downstream side flow path") and is opened when a positive pressure exceeding a predetermined level is generated in the flow path on the ink tank 205 side (hereinafter referred to as an "upstream side flow path").

Cleaning Operation

Cleaning operation can be roughly classified into two types according to whether the differential pressure regulating valve 217 is opened or closed during the cleaning operation.

One is normal cleaning, in which the suction pump 301 (FIG. 2) is activated with the differential pressure regulating valve 217 being opened to discharge ink in the ink flow path 216.

Another is choke cleaning, in which the suction pump 301 (FIG. 2) is activated first with the differential pressure regulating valve 217 being closed to raise the negative pressure in the flow path on a downstream side, the differential pressure regulating valve 217 being then opened to discharge ink in the ink flow path 216 at a time. In this embodiment, the pressure in the flow path on a downstream side, with the differential pressure regulating valve 217 being closed, is about 0.2 atm.

The normal cleaning is performed mainly to remove bubbles deposited near the ejection ports. The choke cleaning is performed mainly to remove bubbles spreading over the entire ink flow path.

Cap Unit

Figure 5:
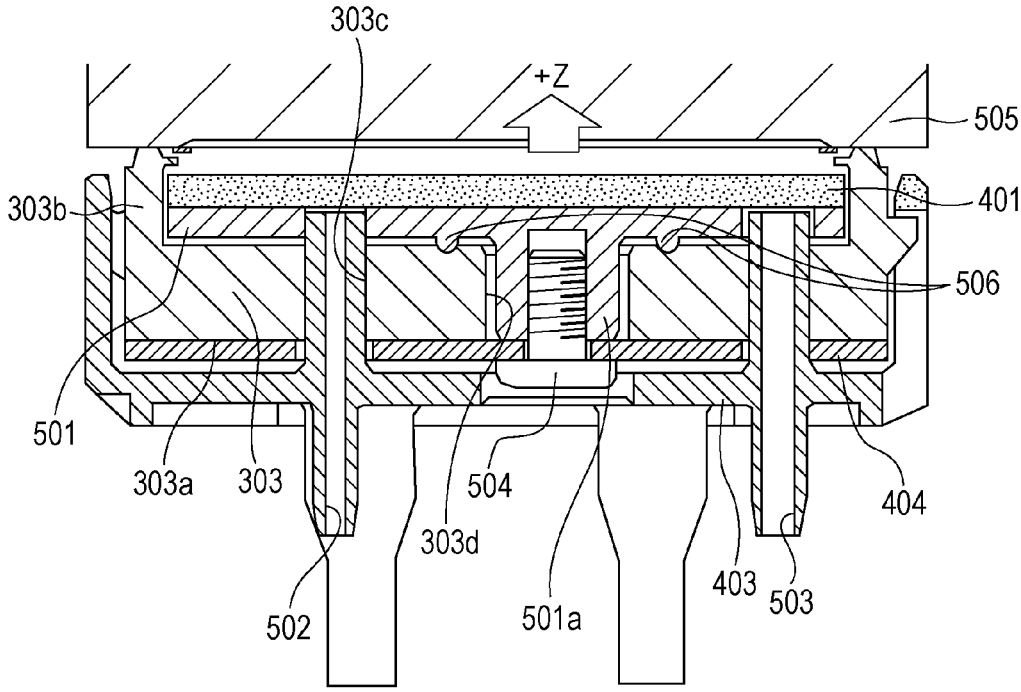
FIG. 5 is a cross-sectional view of the cap unit of the recovery mechanism section in FIG. 2.

FIG. 5 is a cross-sectional view of the cap unit. A deformation restricting member 501 is disposed inside the cap 303 constituting the cap unit. The deformation restricting member 501 is fixed to the cap holder 403, which serves as the cap retaining member, or a plate (herein, the metal plate 404). The cap 303 is sandwiched between the deformation restricting member 501 and the cap holder 403 or the metal plate 404.

The cap holder 403 includes a plurality of tubular ink discharge ports 502 and air communication ports 503. The cap 303 has through-holes 303*c* corresponding to the ink discharge ports 502 and the air communication ports 503. When the inner surfaces of the through-holes 303*c* are brought into intimate contact with the outer surfaces of the ink discharge ports 502 and air communication ports 503, the air-tightness is ensured, and the cap 303 is retained by the friction.

As shown in FIG. 5, the deformation restricting member 501 that covers almost the entire inner surface of the bottom of the cap 303 is disposed between the cap 303 and the ink absorbing members 401. The metal plate 404 is disposed between the cap 303 and the cap holder 403. That is, the cap holder 403, the metal plate 404, the cap bottom 303*a*, the deformation restricting member 501, and the ink absorbing members 401 are stacked in sequence. The deformation restricting member 501 is fixed to the cap holder 403 and the metal plate 404 by a screw 504. Thus, the cap 303 is sandwiched between the deformation restricting member 501 and the metal plate 404. More specifically, the deformation restricting member 501 has a tubular rib 501*a* with a screw formed therein. The cap 303 has a through-hole 303*d* that is different from the through-holes 303*c*, and the metal plate 404 has a first opening that communicates with the through-hole 303*d*. The cap holder 403 has a second opening that communicates with the first opening. The screw 504 inserted in the first and second openings that communicate with each other is threaded with the rib 501*a* inserted in the through-hole 303*d*. Because of this structure, the bottom 303*a* of the cap 303 tends to be deformed toward the ejection port surface of the recording head 505 (+Z direction in FIG. 5) when a negative pressure is generated. However, such deformation is suppressed by the deformation restricting member 501. In addition, because the deformation restricting member 501 covers almost the entire inner surface of the bottom of the cap 303, leaning of the side wall 303*b* of the cap 303 can also be suppressed.

Even without metal plate 404, the above-described advantages can be achieved by fixing the deformation restricting member 501 and the cap holder 403, serving as the cap retaining member, together. Furthermore, the deformation restricting member 501 does not necessarily have to be fastened (fixed) by the screw 504 as in this embodiment, but may be fastened (fixed) by using, for example, snap fitting or a slit ring.

In this embodiment, in which the deformation restricting member 501 and the cap retaining member are fixed to each other, the cap 303 has the through-hole 303*d*. There is a gap between the inner surface of the through-hole 303*d* and the outer surface of the rib 501*a* inserted therein. The air-tightness between the cap 303 and the deformation restricting member 501 has to be ensured to form an enclosed space during capping.

Accordingly, in this embodiment, a projection 506 surrounding the rib 501*a* is provided around the rib 501*a* of the deformation restricting member 501. This projection 506 is brought into contact with the circumference of the through-hole 303*d* in the cap bottom 303*a*, in the above-described stacked state, to ensure the air-tightness between the cap 303 and the deformation restricting member 501. In this embodiment, because both the rib 501*a* and the through-hole 303*d* are circular, the projection 506 is also formed in a circular shape (ring-like shape) surrounding the rib 501*a*. However, the shape of the projection 506 is not limited to a circular shape.

Furthermore, the air-tightness between the cap 303 and the deformation restricting member 501 may be ensured by bringing a projection provided on the cap 303 into contact with the deformation restricting member 501.

Figure 6:
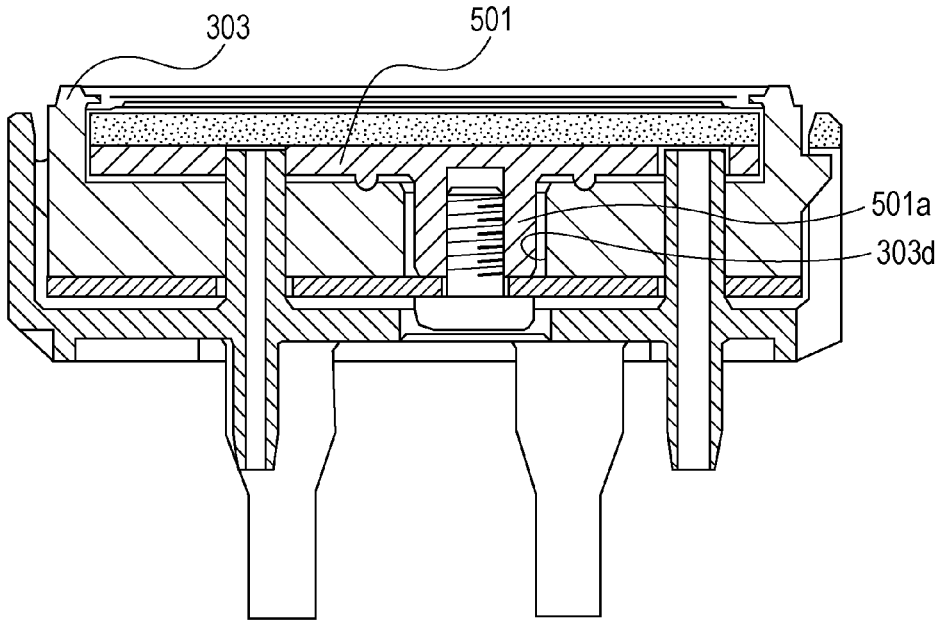
FIG. 6 is a cross-sectional view showing a modification of the cap unit.

In addition, as shown in FIG. 6, the air-tightness between the cap 303 and the deformation restricting member 501 may be ensured by bringing the outer surface of the rib 501*a* of the deformation restricting member 501 into intimate contact with the inner surface of the through-hole 303*d* in the cap 303. This increases the number of sealing portions because the surfaces are brought into contact with each other. Thus, the size of the sealing portions between the cap 303 and the deformation restricting member 501 needs to be carefully selected so that the cap 303 is not deformed.

Second Embodiment

Figure 7:
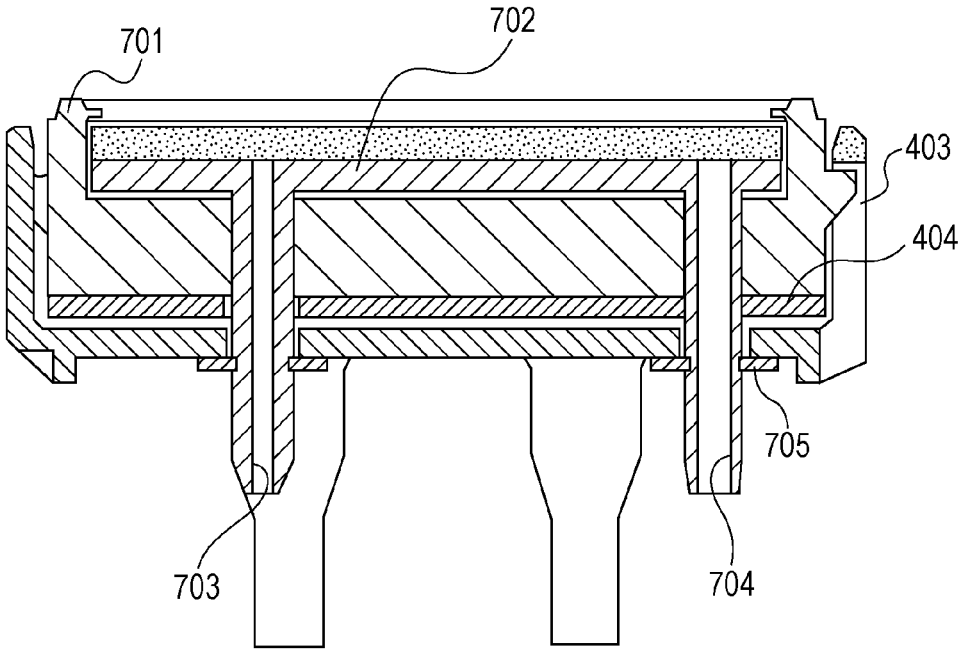
FIG. 7 is a cross-sectional view of a cap unit according to a second embodiment.

FIG. 7 is a cross-sectional view of a cap unit according to a second embodiment. In the cap unit shown in FIG. 7, a tubular ink discharge port 703 and an air communication port 704 are provided in a deformation restricting member 702 so as to be projected therefrom. A cap 701 has through-holes into which the ink discharge port 703 and the air communication port 704 of the deformation restricting member 702 can be inserted. Furthermore, the metal plate 404 and the cap holder 403 each have openings that communicate with each other and also communicate with the through-holes in the cap 701. The tubular ink discharge port 703 and the air communication port 704 penetrate through the through-holes in the cap 701 and the openings in the metal plate 404 and cap holder 403. Falling-off preventing members 705 are attached to the ends of the ink discharge port 703 and air communication port 704 projecting from the openings in the cap holder 403. Thus, the deformation restricting member 702 and the ink holder 403 are fixed to each other. Furthermore, because the inner surfaces of the through-holes in the cap 701 are brought into intimate contact with the outer surfaces of the ink discharge port 703 and air communication port 704, the air-tightness is ensured. With this structure, the deformation restricting member can be disposed without increasing the number of the sealing portions. Thus, the reliability of the sealing performance can be improved.

Third Embodiment

Figure 8:
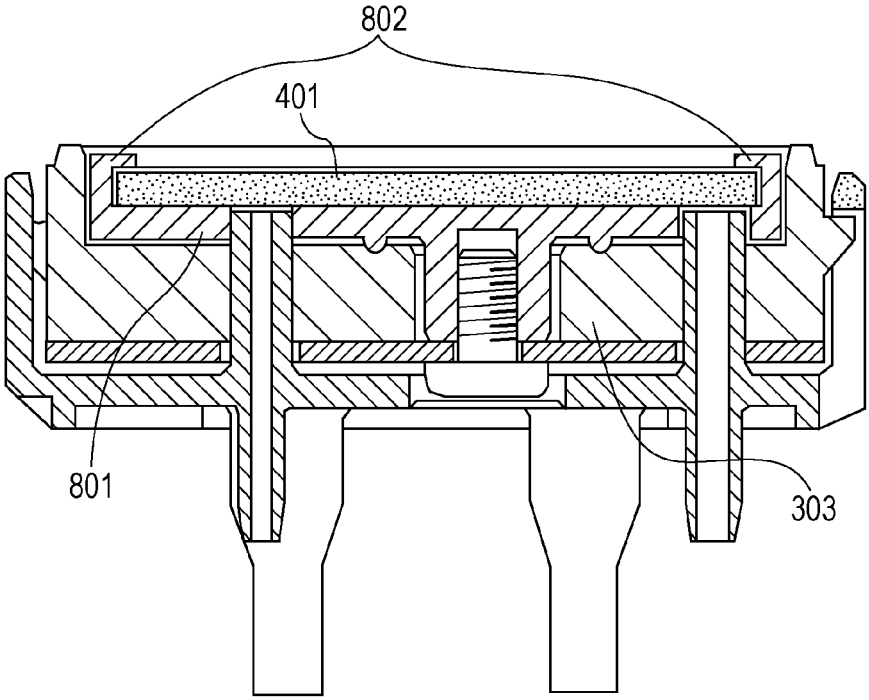
FIG. 8 is a cross-sectional view of a cap unit according to a third embodiment.
Figure 9:
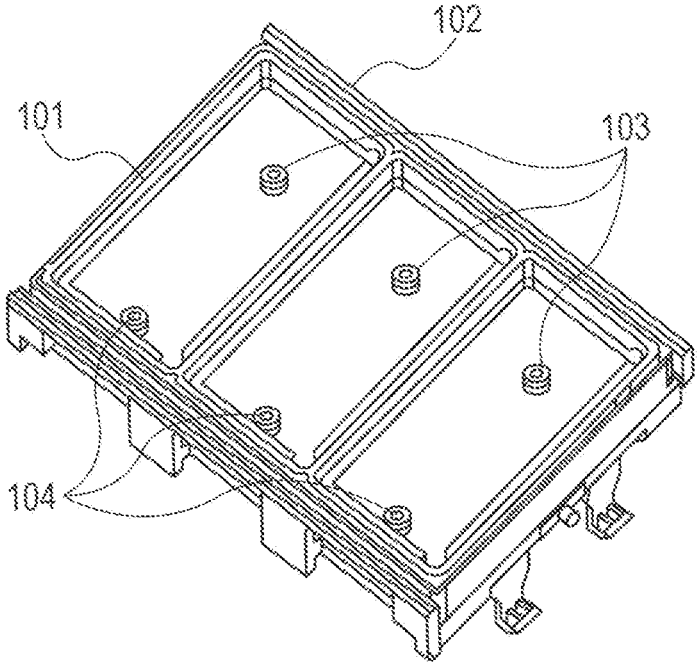
(PRIOR ART) FIG. 9
FIG. 9 shows the structure of a conventional cap unit.

FIG. 8 is a cross-sectional view of a cap unit according to a third embodiment. A deformation restricting member 801 includes an ink-absorbing-member holding portion 802. The ink-absorbing-member holding portion 802 extends beyond the side surfaces of the ink absorbing members 401 toward the top surface. The cap 303 is made of a soft material. The deformation restricting member 801 is made of a plastic resin and is less likely to be deformed when a negative pressure is generated. Accordingly, the ink absorbing members 401 can be more assuredly retained at a stable position.

According to the embodiments of the present invention, because the deformation of the cap can be suppressed when a negative pressure is generated, a reliable suction operation is possible. Thus, excellent performance of the recording head can be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-193576 filed Aug. 31, 2010, which is hereby incorporated by reference herein in its entirety.

What is claimed is:

1. An inkjet recording apparatus comprising:

a cap configured to cap an ejection port surface of a recording head, the cap including a bottom provided with a through-hole, and a side wall surrounding the bottom;

a retaining member configured to retain the cap on the inkjet recording apparatus;

a restricting member provided inside the cap, the restricting member having a rib inserted in the through-hole; and a plate provided between the bottom and the retaining member, the plate having a first opening that communicates with the through-hole, wherein the retaining member has a second opening that communicates with the first opening, and wherein the restricting member and the plate are fixed by being fastened to the rib by a screw inserted in the first opening and the second opening.

2. The inkjet recording apparatus according to claim 1, wherein the restricting member has a projection that is brought into contact with the periphery of the through-hole to form an enclosed space between the restricting member and the cap.

3. The inkjet recording apparatus according to claim 1, wherein the inner surface of the through-hole is in intimate contact with the outer surface of the rib of the restricting member.

4. The inkjet recording apparatus according to claim 1, wherein the restricting member has an ink discharge port and an air communication port;

the bottom has through-holes accommodating the ink discharge port and the air communication port;

the plate is provided between the bottom and the retaining member, the plate having first openings that communicate with the through-holes in the bottom, the retaining member has second openings that communicate with the first openings, the ink discharge port and the air communication port penetrate through the through-holes, the first openings, and the second openings, and falling-off preventing members are fitted to ends of the ink discharge port and air communication port projecting from the second openings.

5. The inkjet recording apparatus according to claim 1, further comprising an ink absorbing member provided inside the side wall of the cap.

6. The inkjet recording apparatus according to claim 1, wherein the restricting member has a projection that is brought into contact with the periphery of the through-hole.

7. The inkjet recording apparatus according to claim 5, wherein a holding portion for holding the ink absorbing member is provided integrally with the restricting member.

* * * * *